US007997347B2

(12) United States Patent
McKee

(10) Patent No.: US 7,997,347 B2
(45) Date of Patent: Aug. 16, 2011

(54) MOBILE COILED TUBING STRAIGHTENING TOOL

(75) Inventor: L. Michael McKee, Friendswood, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 359 days.

(21) Appl. No.: 12/355,101

(22) Filed: Jan. 16, 2009

(65) Prior Publication Data

US 2010/0181078 A1 Jul. 22, 2010

(51) Int. Cl.
*E21B 19/22* (2006.01)
*E21B 29/10* (2006.01)

(52) U.S. Cl. ..... 166/384; 166/77.2; 72/213; 72/389.8

(58) Field of Classification Search ..... 72/213, 72/389.8; 166/77.2, 242.1, 384
See application file for complete search history.

(56) References Cited

U.S. PATENT DOCUMENTS 2,740,309 A * 4/1956 Martin, Sr. ..... 72/458
3,690,136 A 9/1972 Slator et al.
3,724,256 A * 4/1973 Kroetch ..... 72/332
4,484,629 A 11/1984 Terry
6,502,641 B1 1/2003 Carriere et al.
6,530,432 B2 3/2003 Gipson
6,868,902 B1 3/2005 Roodenburg et al.
2003/0010505 A1 1/2003 Gipson

OTHER PUBLICATIONS

Metal Planetary Ring Roller—Model 36790—Assembly and Operation Instructions: Copyright 2000, 2006 by Harbor Freight Tools, Rev Dec. 2006, pp. 1-7.*

* cited by examiner

*Primary Examiner* — David Bagnell
*Assistant Examiner* — Richard Alker
(74) *Attorney, Agent, or Firm* — Michael Dae; David Cate; Robin Nava

(57) ABSTRACT

A handheld tool for straightening coiled tubing in a continuous manner. The tool is configured to straighten coiled tubing that has undergone plastifying deformation, for example, during winding about a coiled tubing reel. The tool is of enhanced mobility and may be employed to provide a straightened portion of coiled tubing without resorting to intermittent reverse kinking or corrugating of the coiled tubing. Rather, the substantially continuous character of the straightened portion of coiled tubing is well suited for stably and reliably accommodating a downhole tool for use within a well during hydrocarbon recovery applications.

20 Claims, 6 Drawing Sheets

MOBILE COILED TUBING STRAIGHTENING TOOL

FIELD

Embodiments described relate to coiled tubing applications in hydrocarbon wells. In particular, embodiments for dealing with residual bend in plastically deformed coiled tubing are detailed.

BACKGROUND

Exploring, drilling and completing hydrocarbon and other wells are generally complicated, time consuming and ultimately very expensive endeavors. As such, tremendous emphasis is often placed on well access in the hydrocarbon recovery industry. That is, access to a well at an oilfield for monitoring its condition and maintaining its proper health is of great importance. As described below, such access to the well is often provided by way of coiled tubing.

Coiled tubing may be configured to deliver interventional or monitoring tools downhole and it may also accommodate fluid through its interior for a host of downhole applications. Furthermore, coiled tubing is particularly well suited for being driven downhole, to depths of perhaps several thousand feet, by an injector at the surface of the oilfield. Thus, with these characteristics in mind, the coiled tubing will also generally be of sufficient strength and durability to withstand such applications. For example, the coiled tubing may be of stainless steel or other suitable metal based material.

In spite of being constructed of a relatively heavy metal based material, the coiled tubing is plastically deformed and wound about a drum to form a coiled tubing reel. In this manner, the coiled tubing may be manageably delivered to the oilfield for use in a well thereat. Once positioned at the oilfield, the coiled tubing may be unwound from the reel and directed through the well by way of the noted injector equipment at the oilfield surface. However, due to the noted plastifying deformation, a residual bend is left in the coiled tubing as it is unwound for use. For certain applications, this residual bend may pose a problem. For example, in the case of highly deviated wells or extended reach wells of tens of thousands of feet in depth, it is likely that the bend in the coiled tubing will eventually result in helical locking up of the coiled tubing. Ultimately, this lock up will prevent the injector from driving the coiled tubing any further through the well. Thus, the coiled tubing may fail to reach the application site in the well.

In order to prevent helical lock up of coiled tubing in applications run in deviated or deep wells, the injector may be specially fitted with a reverse bend mechanism. The reverse bend mechanism may be a large heavy tool that is integrated into the body of the injector and configured to bend the coiled tubing in a manner opposite the plastifying deformation bend noted above. Thus, several thousand feet of coiled tubing may be straightened as it is run through the injector and driven downhole for the application.

Additionally, for many downhole applications, such as those targeting shallower depths in relatively vertical wells, the bent end of the coiled tubing may be problematic even though helical lock up may be of no significant concern. In such circumstances, the addition of a large and expensive reverse bend mechanism to the injector may accomplish little more than add to the weight and expense of equipment brought to the worksite.

Given the difficulty that a user encounters in feeding the bent end of the coiled tubing into the injector, a mobile, handheld reverse kinking mechanism is often employed by the user. The reverse kinking mechanism may be employed to reduce the amount of bend at the end of the coiled tubing thereby allowing the user to more easily feed the coiled tubing into the injector. For example, the user may slide the end of the coiled tubing through the mechanism a given amount and activate the mechanism. Activation of the mechanism involves physically inducing a kink, opposite the direction of the bend. This may be repeated in several isolated locations until the relatively uniform curvature at the end of the coiled tubing is replaced with a series of kinks that leave a repeating 'w' or corrugated appearance. While such 'straightening' is discontinuous and thus, not entirely straight, the now corrugated end of the coiled tubing may be easier for the user to manipulate and feed into the injector.

Unfortunately, corrugating the end of the coiled tubing with a reverse kinking mechanism as described above may still leave a difficult to manage coiled tubing end in certain regards. That is, while perhaps sufficient for feeding the injector, the user may deal with the end of the coiled tubing for a host of other reasons, some of which may call for a straighter coiled tubing end than the reverse kinking mechanism is able to provide. For example, a tool-string or even individual tools may be secured to the end of the coiled tubing for performance of monitoring and/or well intervention applications in the well. Securing such devices properly to the end of the coiled tubing may be critical to ensuring that the application is properly run without damage to, or loss of the devices. While the degree of bend may be reduced by the reverse kinking mechanism, in circumstances where the remaining bend in the coiled tubing end prevents a physically secure coupling of devices thereto, the user is placed in an unenviable predicament. That is, the user may be left with having to choose between risking device loss and having to re-run the application versus running the entire coiled tubing application through an otherwise unnecessary, more expensive and less available injector with incorporated reverse bend mechanism.

SUMMARY

A mobile tool for straightening a portion of coiled tubing is provided. The tool includes first and second rollers for positioning against one side of the coiled tubing. An additional intermediate roller is provided for positioning against a second opposite side of the coiled tubing. This intermediate roller is disposed between the first and second rollers and adjustably positionable relative thereto for the straightening of the portion of the coiled tubing.

A mobile tool for straightening a portion of coiled tubing may be provided that is made up of two separate frame portions. The first frame portion may accommodate an intermediate roller and a first opposite roller, whereas the second frame portion may accommodate a second opposite roller. The second frame portion may be coupled to the first frame portion for pivoting relative thereto. The portion of the coiled tubing may be disposed between the intermediate roller and the opposite rollers to allow the pivoting to effect the straightening.

A method of straightening a portion of coiled tubing is also disclosed. In one embodiment a mobile handheld tool may be provided with first and second rollers located at a side thereof and an intermediate roller located at another side thereof and between the first and second rollers. The portion of the coiled tubing may be inserted within the mobile handheld tool between the sides. Thus, a position of the intermediate roller relative to the first and second rollers may be adjusted for the straightening.

DETAILED DESCRIPTION

Embodiments of mobile coiled tubing straightening tools are described with reference to certain coiled tubing applications herein. As such, certain configurations of coiled tubing and downhole tools are depicted. For example, a coiled tubing operation employing a perforation gun is shown in certain figures. However, a variety of other downhole tools may be utilized in conjunction with coiled tubing that is straightened by the straightening tool. Regardless, embodiments of the straightening tool may be handheld and provide substantially continuous straightening to allow for a secure coupling of a downhole tool to a straightened end of the coiled tubing.

Figure 1:
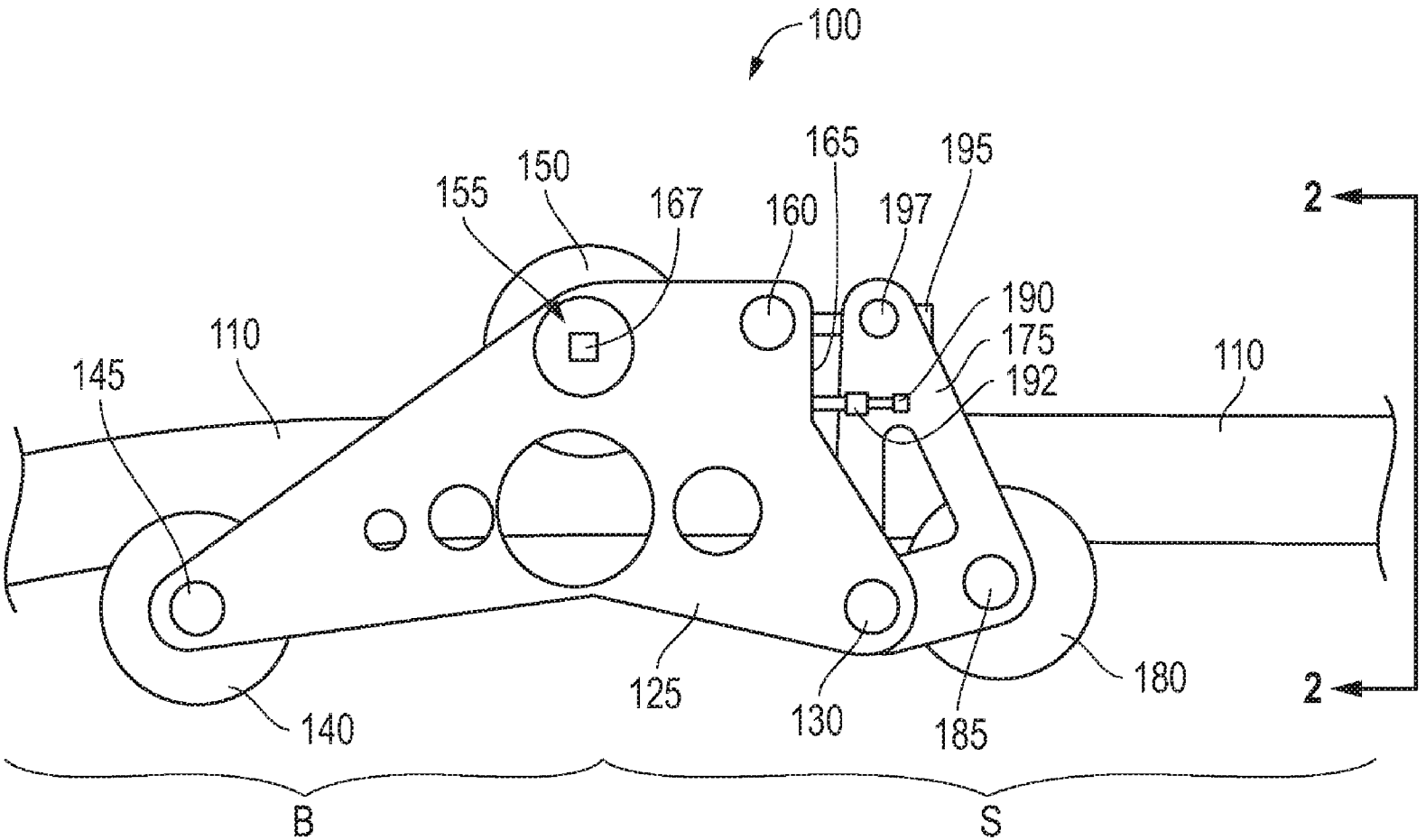
FIG. 1 is a side view of an embodiment of a mobile coiled tubing (CT) straightening tool employed in straightening coiled tubing.

Referring now to FIG. 1, an embodiment of a mobile coiled tubing straightening tool 100 is depicted. The straightening tool 100 is shown straightening a section of coiled tubing 110. That is, as depicted, bent coiled tubing (B) may be inserted into the straightening tool 100 at the left side thereof. The tool 100 may then be adjusted as detailed herein and advanced leftward relative to the coiled tubing 110. As such, straightened coiled tubing (S) may be emitted from the right side of the tool 100. The straightening tool 100 is particularly user-friendly and beneficial in that it may be relatively lightweight and handheld or hand carried to a worksite. Furthermore, the tool 100 is equipped with a powered intermediate roller 150 to allow continuous straightening of the coiled tubing 110. Thus, unlike conventional handheld coiled tubing straightening devices, the entirety of the coiled tubing 110 which passes through the tool 100 may be straightened (e.g. as the depicted straightened coiled tubing (S) reveals).

Continuing with reference to FIG. 1, the straightening tool 100 is equipped with first 140 and second 180 passive rollers. The central portions of these rollers 140, 180, along with the above-noted intermediate roller 150, are concavely shaped to correspondingly accommodate the coiled tubing 110 as shown. Additionally, the passive rollers 140, 180 are positioned at an opposite side of the body of the tool 100 relative to the intermediate roller 150. In the embodiment shown, these rollers 140, 180 are passive in the sense that they are configured to passively rotate about passive hubs 145, 185 while guiding and supporting movement of the coiled tubing 110 from left to right as depicted. It is the powered intermediate roller 150 on the other hand which is configured to drive the noted movement of the coiled tubing 110. However, in alternate embodiments, rollers 140, 180 aside from the intermediate roller 150 may similarly be directly powered.

Powering of the intermediate roller 150 may be achieved through coupling an external power source to the power hub 155. For example, in the embodiment shown, the power hub 155 is equipped with a mechanical drive shaft or socket 167 for receiving a manual, pneumatic or hydraulic wrench. Once coupled to the socket 167, the wrench may be employed to rotate the hub 155 and roller 150 in a counterclockwise direction (see arrow 250 of FIG. 2). As such, the coiled tubing 110 may be forced from left to right as described above.

Moving the coiled tubing 110 from left to right results in straightening as described above. As detailed further below, this is due to the fact that the powered roller 150 and the passive rollers 140, 180 are shifted from an initial position of loosely receiving bent coiled tubing (B) (as depicted in FIG. 4A), to a position of induced deflection as shown in FIG. 1 (also see FIG. 2). In the position of induced deflection, all of the coiled tubing 110 from the location of the powered roller 150 to the right end as shown, is actually reverse bent and deflected upward by the roller 150. The amount of reverse bending or deflection is determined based roughly on the calculated amount necessary to overcome the plastic deformation originally induced in the coiled tubing 110 (e.g. during placement about a coiled tubing reel 310 for delivery to the oilfield 375 as shown in FIG. 3). Overcoming such induced plastic deformation results in the straight coiled tubing (S) as shown.

In the embodiment of FIG. 1, shifting of the powered 150 and passive 140, 180 rollers relative to one another is achieved through use of separate frames 125, 175 which are pivotally coupled to one another at a pivot joint 130. However, other mechanisms may be employed to achieve such relative change in roller positioning. Nevertheless, as depicted, the intermediate roller 150 and a first passive roller 140 are accommodated by a first frame 125, whereas the second passive roller 180 is alone accommodated by a second frame 175. Due to the presence of the pivot joint 130, the second passive roller 180 may initially be in a loose position with the second frame 175 deflected away from the face 165 of the first frame 125 as shown in FIG. 4A. The second frame 175 may then subsequently be pivoted into closer range of the face 165 as depicted in FIG. 1. In this manner, the position of the second passive roller 180 may be tightened and the initial deflection or reverse bend in the coiled tubing 110 initiated as detailed further below with respect to FIG. 2. Additionally, with rotation of the powered roller 150 as noted above, this reverse bending may continue beyond the initial isolated reverse bend location, thereby resulting in a continuous straightening of the coiled tubing 110 as described.

Control over movement of the second frame 175 toward the first 125 about the pivot joint 130 as described above, may be achieved by way of an adjustment mechanism 195. As shown in FIG. 1, the adjustment mechanism 195 may be a conventional bolt which is securely located through a block mount 197 of the second frame 175 and threaded into a block mount 160 of the first frame 125. As such, turning of the mechanism 195 may be employed to position the second frame 175 relative the first 125, for example, moving the second frame 175 closer to the face 165 of the first 125 to begin the straightening process.

The second frame 175 may also be equipped with a guidance mechanism 190 to limit the degree of movement which may be achieved by way of the adjustment mechanism 195. In this manner, overcorrected bending of the coiled tubing 110 may be avoided. As shown, the guidance mechanism 190 may again be a conventional bolt. In this case, however, the mechanism 190 may be threaded through a retainer 192 of the second frame 175 only. That is, rather than adjustably coupling to the first frame 125, the guidance mechanism 190 may act as a stop, merely abutting the face 165 of the first frame 125. Thus, the guidance mechanism 190 may prevent further tightening of the second frame 175 relative the first 125 once the appropriate calculated distance therebetween has been achieved. Thus, the unintended formation of any new bent portion of coiled tubing 110 may be avoided. As detailed further herein below, effectively calculating such a distance and setting the positioning of the guidance mechanism 190 may be determinative of the overall degree of straightening of the coiled tubing 110 that is ultimately achieved.

Figure 2:
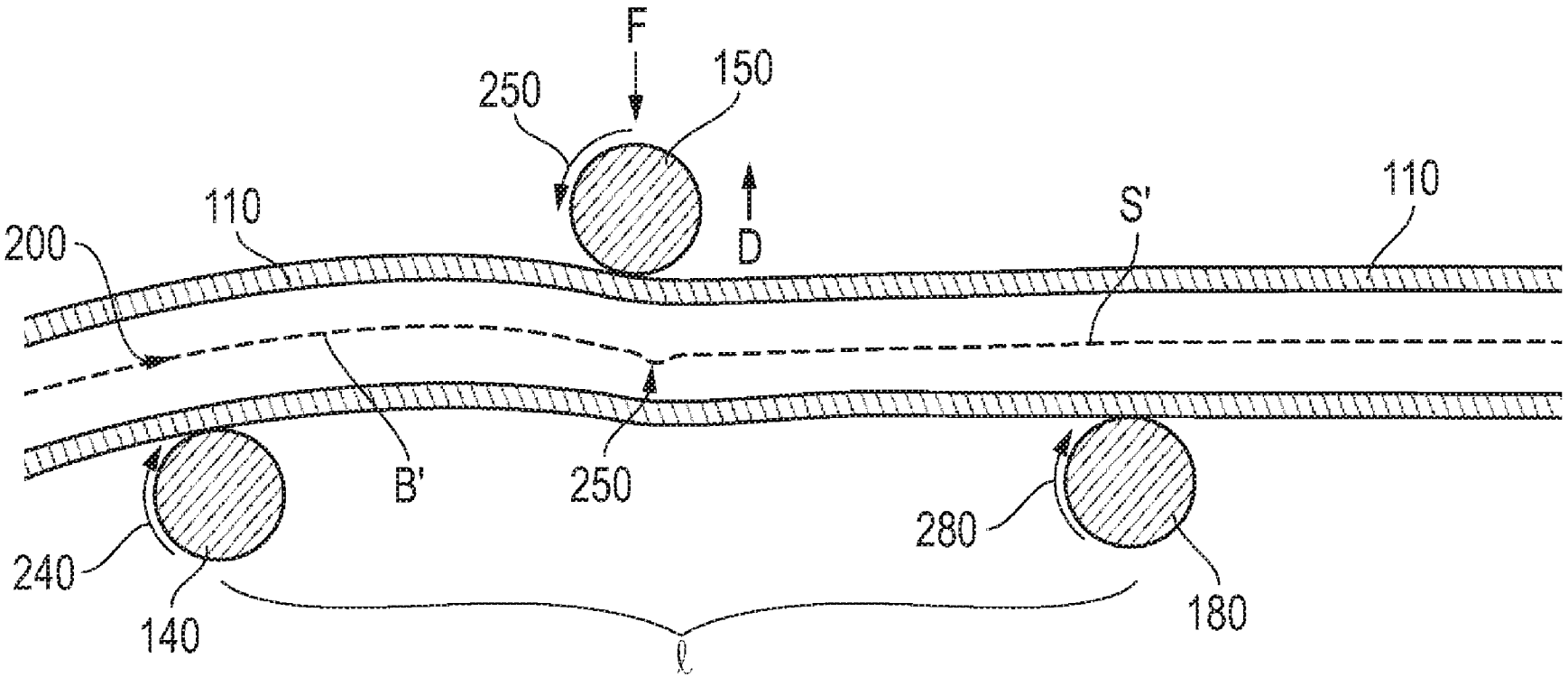
FIG. 2 is a side cross-sectional view of the mobile CT straightening tool and coiled tubing taken from 2-2 of FIG. 1.
Figure 3:
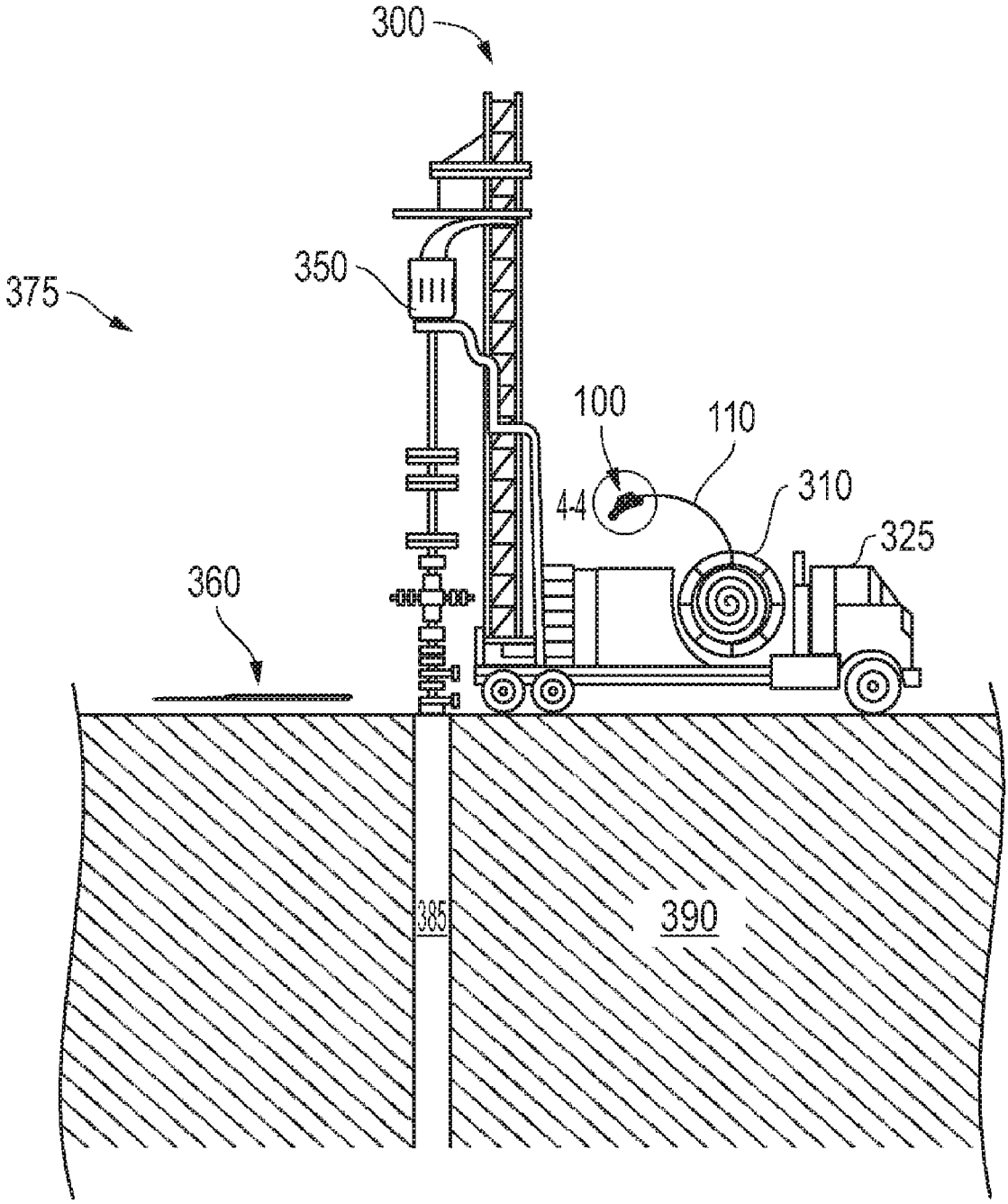
FIG. 3 is an overview of an oilfield having a well for access by the coiled tubing upon straightening by the mobile CT straightening tool of FIG. 1.

Continuing now with added reference to FIG. 2, a cross-sectional view of the straightening tool 100 about the coiled tubing 110 is depicted. In particular, the described tightening of the second roller 180 reveals the force (F) that is imparted by the powered roller 150 on the coiled tubing 110. As shown, his downward force (F) induces a certain amount of reverse bend or upward deflection (D). From the perspective of a central axis 200 through the coiled tubing 110, a bent axis portion (B') may be converted to a straightened axis portion (S') from a location 250 immediately adjacent the powered roller 150. This straightening may move beyond a mere reverse kink at an isolated location. That is, the straightening tool 100 may be employed in a continuing manner, with the straightened axis portion (S') extending as the powered roller 150 rotates counterclockwise (see arrow 250) and the passive rollers 140, 180 rotate clockwise (see arrows 240, 280).

Continuing with reference to FIGS. 1 and 2, with added reference to FIG. 3, a more specific example of straightening of coiled tubing 110 is described here with reference to rough calculations for achieving the straightening. For example, consider a conventional steel-based coiled tubing 110 with an outer radius of about 2 ⅞ inches and a wall thickness of about 0.19 inches. From a reel 310, it would not be uncommon to see such a coiled tubing 110 with a significant bend radius, perhaps about 380 inches. Thus, in order to allow for reliable coupling of a downhole tool 360 to the coiled tubing 110, the end thereof may be straightened as described herein.

Given a coiled tubing 110 as noted above, the amount of deflection for effective straightening may be roughly calculated according to the following equation.

$$\Delta x=(\sigma/R_o)\ (l^2/12E)$$

In this case Δx is the deflection or displacement that is roughly employed to achieve straightening, whereas σ represents the plastifying yield stress of the coiled tubing 110, $R_o$ its outer radius, l the length (l) between the passive rollers 140, 180 as depicted in FIG. 2, and E is the modulus of elasticity found in the coiled tubing material. Thus, with particular reference to the straightening tool 100 and the coiled tubing dimensions and materials noted above, it would be feasible to see values such as 80,000 psi for the plastifying yield stress (σ), 1.4375 inches for the outer radius ($R_o$) of the coiled tubing 110, about 20 inches for the length (l) between the passive rollers 140, 180, and 30 million psi as the modulus of elasticity (E).

Running the calculations with such values as those noted above would result in a displacement (Δx) of about 0.062 inches in order to achieve straightening as depicted in FIGS. 1 and 2. Thus, based on predetermined dimensional criteria, the guidance mechanism 190 may be set to allow no more than 0.062 inches of deflection, the straightening tool 100 loosely positioned over the end of the coiled tubing 110, and the adjustment mechanism 195 tightened until the guidance mechanism 190 meets the face 165 of the first frame 125. At this time, an isolated location of straightening may be obtained that may then be extended through the coiled tubing 110 as the powered roller 150 is rotated as described herein.

With particular reference to FIG. 3, an overview of an oilfield 375 is shown. In this depiction, the value of having available a handheld straightening tool 100 of less than about 25 inches in length may be appreciated in a practical sense. As shown, the coiled tubing 110 is plastically deformed about a coiled tubing reel 310 and delivered to the oilfield 375 by way of a coiled tubing truck 325. The truck 325 is positioned adjacent interventional surface equipment 300 and a well 385 to be accessed by the coiled tubing 110. In the embodiment shown, well access by the coiled tubing 110 is utilized in order to deliver a downhole tool 360 through the well 385 to a relatively shallow dowhole location adjacent a formation 390 as described further with reference to FIG. 6. Given that the coiled tubing 110 is to accommodate a downhole tool 360, the lightweight mobile straightening tool 100 may be manually positioned at the end of the tubing 110 and employed as described above.

Figure 4B:
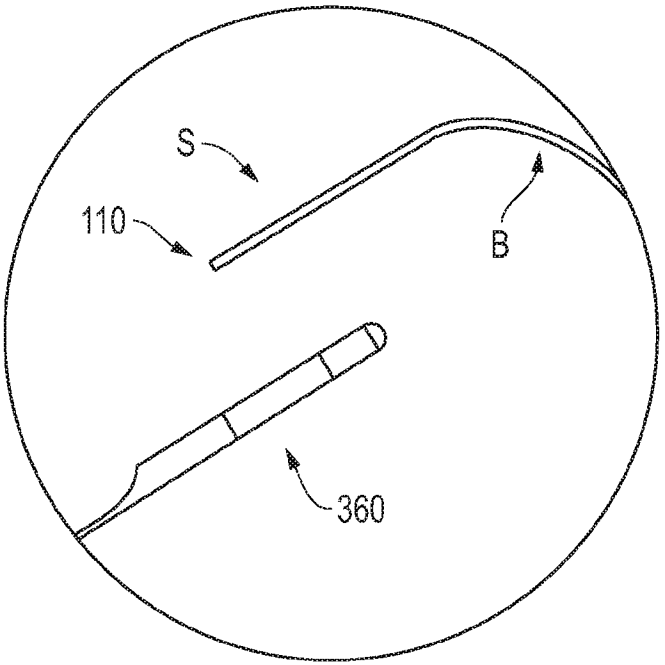
FIG. 4B is an enlarged view of the end of the coiled tubing of FIG. 4A having a straightened portion for coupling to a downhole tool.
Figure 4A:
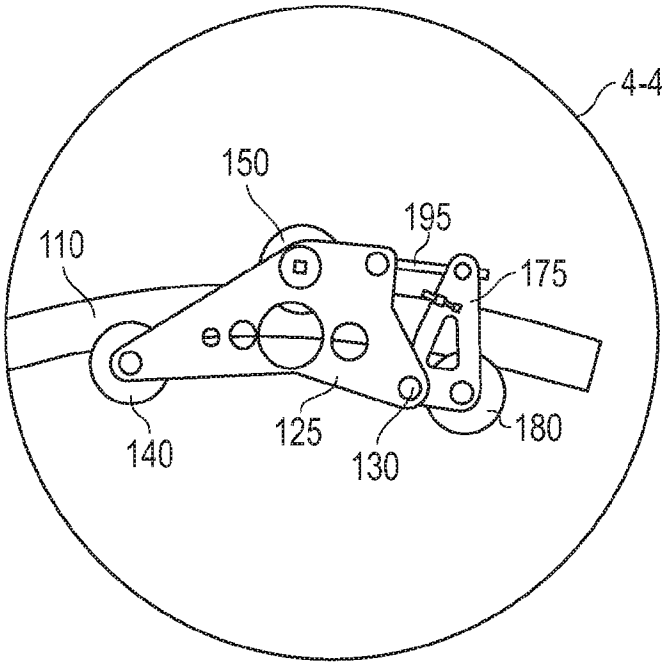
FIG. 4A is an enlarged view of the end of the coiled tubing with mobile CT straightening tool thereabout taken from 4-4 of FIG. 3.

With added reference to FIGS. 4A and 4B, straightening of the coiled tubing 110 and coupling of the downhole tool 360 thereto is described. FIG. 4A in particular is an enlarged view of the straightening tool 100 as it is initially loosely positioned over the end of the coiled tubing 110. By way of comparison to FIG. 1, the second frame 175 is relatively more distanced from the first frame 125 about the pivot joint 130. Note the longer appearance of the adjustment mechanism 195. Thus, all of the rollers 140, 150, 180 may stably interface the coiled tubing 110, yet without, at this point, deformably effecting straightening as detailed hereinabove. Nevertheless, once positioned, straightening techniques employing the straightening tool 100 may ensue as described above.

Ultimately, as depicted in FIG. 4B, straightened coiled tubing (S) may be provided that is mechanically well suited for coupling to a downhole tool 360. In the embodiment shown, the straightening tool 100 may be particularly advantageous for use where coupling of a downhole tool 360 is of primary concern with regard to straightening. For example, as shown in FIG. 4B, the coiled tubing 110 is left with both bent coiled tubing (B) and the noted straightened coiled tubing (S). However, given the shallow depth of the application to be run with the coiled tubing 110, the value of straightening lies primarily in the stable securing of the downhole tool as opposed to say avoiding downhole helical lock-up of the coiled tubing 110. Thus, bent coiled tubing (B) may be of no significant concern so long as the end of the coiled tubing is straightened. As such, the need for a conventional expensive, heavy, and comparatively immobile straightening tool incorporated into the body of the coiled tubing injector 350 may be obviated.

In addition to coupling of the downhole tool 360, the straightened coiled tubing (S) may present well for coupling of other devices. For example, another section of coiled tubing may be more easily coupled to the straightened coiled tubing (S) by way of a coupling collar, welding, or another mechanism adjoining the tubings. That is, the straightening tool 100 may be employed in order to extend the length of coiled tubing for an operation in a user friendly manner by straightening the ends of separate coiled tubing sections which may then be adjoined via a coupling collar, weld or mechanism as noted.

Figure 5:
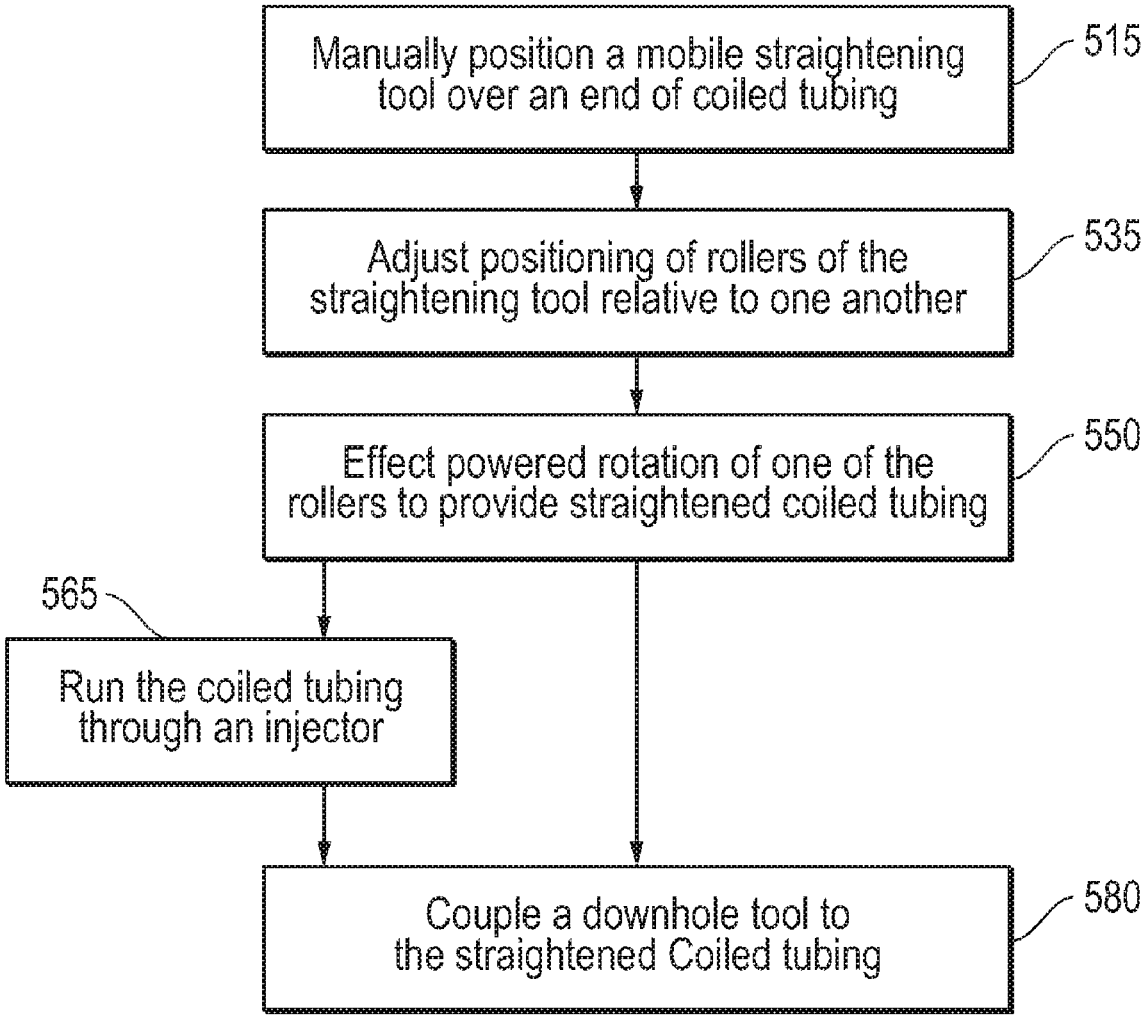
FIG. 5 is a flow-chart summarizing an embodiment of straightening a bent end of coiled tubing.

Referring now to FIG. 5, a method of employing an embodiment of a straightening tool is summarized in the form of a flow chart. That is, the tool may be loosely positioned over the end of coiled tubing as indicated at 515. As shown at 535, the position of rollers of the tool may then be adjusted relative to one another in order to initiate straightening at a given location of the tubing. One of the rollers may then be powered to rotate as noted at 550, thereby extending reverse bend over a continuous length of the coiled tubing to provide straightening. With the straightened portion of coiled tubing available, a downhole tool may be coupled thereto as indicated at 580. Additionally, as indicated at 565, depending on physical characteristics of the downhole tool, it may be coupled to the straightened portion of the coiled tubing after the tubing is run through a coiled tubing injector.

Figure 6:
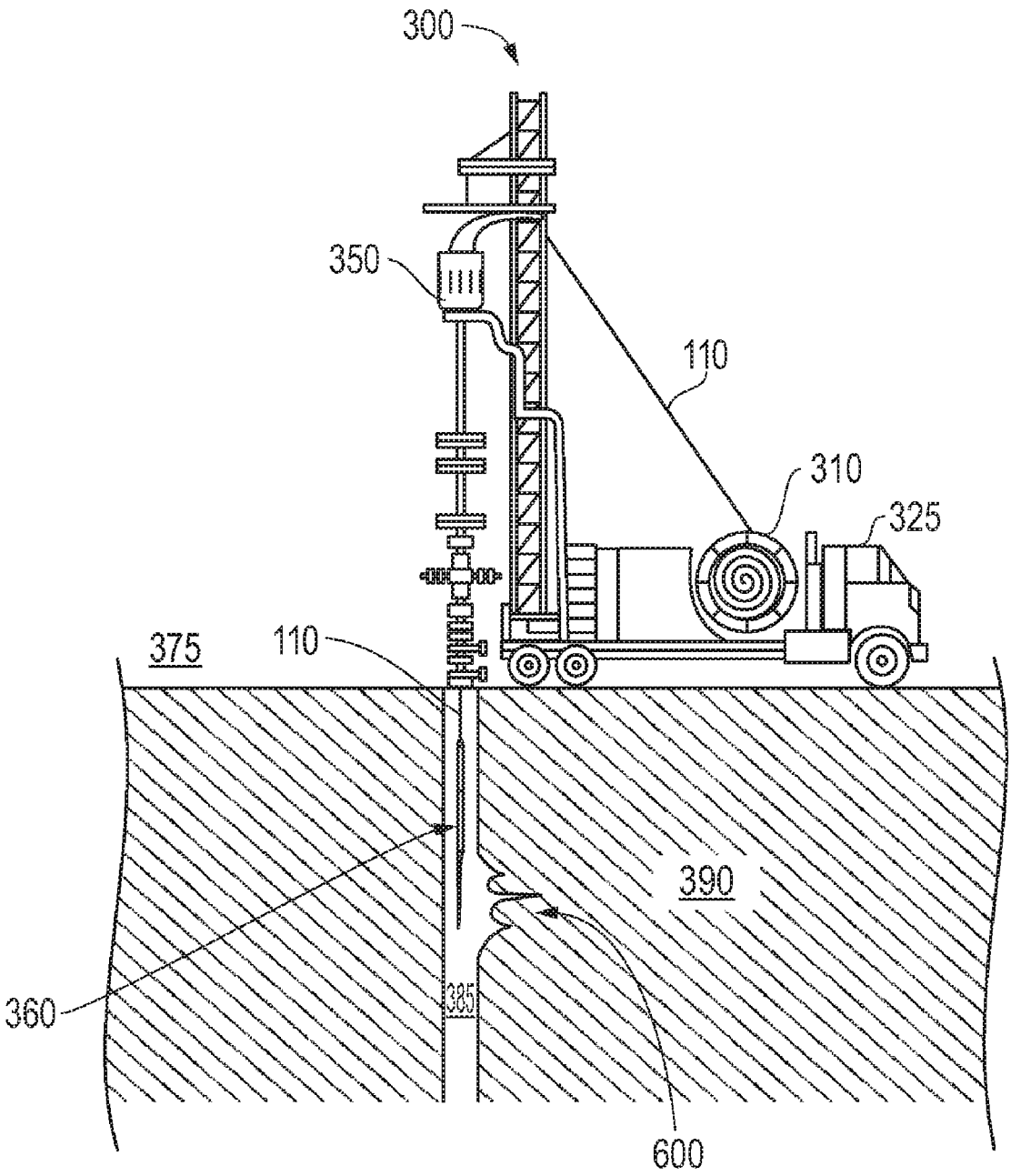
FIG. 6 is an overview of the oilfield of FIG. 3 with the well accommodating a downhole tool secured to a straightened portion of the end of the coiled tubing.

Referring now to FIG. 6, the downhole tool 360 is depicted as a perforation gun for forming perforations 600 into the formation 390 adjacent the well 385. Such techniques may be pursued to aid in hydrocarbon recovery from the formation 390. Regardless, the location of the perforations 600 is relatively shallow. Thus, the primary concern presented by a plastically deformed and bent coiled tubing 110 relates to securing of the downhole tool 360 thereto, as opposed to avoiding downhole helical seizure of the tubing. Thus, a lightweight, handheld mobile coiled tubing straightening tool 100 as depicted and described with reference to FIGS. 1-4 may be employed to ensure coiled tubing straightening sufficient for adequate security of the downhole tool 360.

Embodiments described hereinabove provide a coiled tubing straightening tool and techniques for straightening coiled tubing that are user-friendly and effective. The straightened coiled tubing may be continuously straightened without intermittent curvature or corrugated dimensions. Thus, security of a downhole tool coupled to the straightened portion of coiled tubing may be enhanced. Furthermore, the continuous straightening may be provided by way of a handheld, mobile, relatively inexpensive straightening tool.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

I claim:

1. A handheld tool for straightening of a portion of coiled tubing, the tool comprising:

first and second rollers for positioning against a first side of the coiled tubing portion; and an intermediate roller for positioning against a second side of the coiled tubing portion opposite the first side, said intermediate roller disposed between said first and second rollers and for adjustable positioning relative thereto for the straightening.

2. The handheld tool of claim 1 wherein said intermediate roller is configured for powering the straightening.

3. The handheld tool of claim 2 wherein said intermediate roller is configured to interface a wrench for the powering.

4. The handheld tool of claim 1 wherein the straightening of the portion is substantially continuous.

5. The handheld tool of claim 1 is less than about 25 inches in length when used to straighten a portion of coiled tubing.

6. The handheld tool of claim 1 further comprising:

a first frame portion to accommodate said first and intermediate rollers; and a second frame portion to accommodate said second roller and pivotally coupled to said first frame for the adjustable positioning.

7. A mobile tool for straightening of a portion of coiled tubing, the tool comprising:

a first frame portion accommodating an intermediate roller and a first opposite roller; and a second frame portion pivotally coupling to said first frame portion for pivoting relative thereto and accommodating a second opposite roller, the portion of the coiled tubing to be disposed between the intermediate roller and the opposite rollers to allow the pivoting to effect the straightening.

8. The mobile tool of claim 7 further comprising:

a pivot joint for the coupling disposed between the opposite rollers; and an adjustment mechanism coupled to each said frame portion and distanced from said pivot joint for controlling the pivoting.

9. The mobile tool of claim 8 wherein said adjustment mechanism is disposed through a block mount of said second frame portion and threaded into a block mount of said first frame portion.

10. The mobile tool of claim 9 wherein said adjustment mechanism is a bolt configured for turning to direct the controlling.

11. The mobile tool of claim 9 further comprising a guide mechanism retainably coupled to said second frame portion and adjustably extendable toward said first frame portion to limit the pivoting of said frame portions toward one another.

12. A method of straightening a portion of coiled tubing, the method comprising:

providing a mobile handheld tool with first and second rollers located at a side thereof and an intermediate roller located at another side thereof, the intermediate roller disposed between the first and second rollers;

inserting the portion of the coiled tubing within the mobile handheld tool between the sides; and adjusting a position of the intermediate roller relative to the first and second rollers for the straightening.

13. The method of claim 12 further comprising powering one of the rollers to extend the straightening over the portion in a substantially continuous manner.

14. The method of claim 13 wherein said powering comprises powering the intermediate roller with a wrench.

15. The method of claim 12 further comprising:

coupling a downhole tool to the portion; and running an application in a well with the downhole tool.

16. The method of claim 12 wherein the portion of the coiled tubing is a first portion, the method further comprising:

coupling a second coiled tubing portion to the first coiled tubing portion; and running an application in a well through the portions.

17. The method of claim 12 further comprising establishing a degree of displacement of the position for said adjusting.

18. The method of claim 17 wherein said establishing is based on one of plastifying yield stress of the coiled tubing, an outer radius of the coiled tubing, a modulus of elasticity of the coiled tubing, and a length between the first and second rollers.

19. A coiled tubing assembly comprising:

a bent portion of coiled tubing; and a straightened portion of coiled tubing contiguous with said bent portion and of substantially continuous straightened character effectuated by a handheld straightening tool; and wherein the handheld tool effectuates the character by adjustment of a position of a roller thereof at one side of the coiled tubing relative to rollers thereof at another side of the coiled tubing.

20. The coiled tubing assembly of claim 19 further comprising a downhole tool coupled to said straightened portion.

* * * * *